US006778793B2

(12) United States Patent
de Kesel

(10) Patent No.: US 6,778,793 B2
(45) Date of Patent: Aug. 17, 2004

(54) SEALING MEMBER FOR TONER CARTRIDGE

(75) Inventor: Jan de Kesel, Drongen (BE)

(73) Assignee: CF Technologies, Deinze (BE)

( * ) Notice: Subject to any disclaimer, the term of this patent is extended or adjusted under 35 U.S.C. 154(b) by 0 days.

(21) Appl. No.: 10/071,254

(22) Filed: Feb. 8, 2002

(65) Prior Publication Data

US 2003/0152397 A1 Aug. 14, 2003

(51) Int. Cl.[7] ..... G03G 15/08
(52) U.S. Cl. ..... 399/106; 399/103
(58) Field of Search ..... 399/102, 103, 399/105, 106, 109; 222/DIG. 1

(56) References Cited

U.S. PATENT DOCUMENTS

| | | | | |
|---|---|---|---|---|
| 3,388,853 A | | 6/1968 | Matich, Jr. et al. | |
| 5,110,646 A | | 5/1992 | Prestel et al. | 428/43 |
| 5,826,140 A | | 10/1998 | Zona et al. | 399/106 |
| 6,041,202 A | | 3/2000 | Cornelius | |
| RE36,920 E | | 10/2000 | DeKesel | 399/106 |
| 6,188,421 B1 | * | 2/2001 | Hayashi et al. | 399/106 X |
| 6,253,043 B1 | * | 6/2001 | Isobe | 399/103 |
| 6,501,924 B2 | * | 12/2002 | Nagashima | 399/106 |
| 2003/0012581 A1 | | 1/2003 | De Kesel | |

FOREIGN PATENT DOCUMENTS

| | | | |
|---|---|---|---|
| EP | 0 788 033 | | 8/2001 |
| JP | 01161274 A1 | | 6/1989 |
| JP | 01310372 A1 | | 12/1989 |
| JP | 04006046 A1 | | 1/1992 |
| JP | 05-289513 | * | 11/1993 |
| JP | 02028673 A1 | | 2/2002 |
| JP | 2002040780 A1 | | 2/2002 |

* cited by examiner

*Primary Examiner*—Sophia S. Chen
(74) *Attorney, Agent, or Firm*—Darby & Darby

(57) ABSTRACT

A sealing film for a toner cartridge or container. The sealing film has a layer with a thickness of between 20 $\mu$m and 1 mm and has at least on substantially linear tearing direction. The layer also includes surface elements that extend in a direction that is different from the preferred tearing direction of the sealing film.

60 Claims, 5 Drawing Sheets

SEALING MEMBER FOR TONER CARTRIDGE

FIELD OF THE INVENTION

The present invention relates to a sealing film for toner cartridge ensuring the formation of an opening with a substantially constant width after tearing a central longitudinal portion of said sealing film.

THE PRIOR ART

Up to now many researches have been made in order to find a sealing film for sealing a toner cartridge, which is flexible and which after longitudinal tearing, is suitable for defining an opening with a substantially constant width.

Prestel at al (U.S. Pat. No. 5,110,646) discloses a sealing member not having a preferred tearing direction, which is provided with a series of adjacent perforations Such perforations cause leakage of toner particles, whereby the use of such sealing member has not be considered as useful by the man skilled in the art.

Films having a preferred tearing linear direction are nowadays used extensively for sealing toner container. However, even with means for lowering the initial tearing force, the opening formed after tearing a central strip is reduced most of the time, some times increased, from the initial tearing end up to the terminal tearing end.

For ensuring a substantially constant width of the opening formed after tearing a central strip from the sealing film, EP-0 788 033 (Canon) has proposed to use a sealing film comprising a base layer having a tearing directionality, a guide layer having a tearing guide portion formed by a laser processing, and a laser barrier layer provided between said base layer and said guide layer. Such a film is expensive and the risk to have an undesired tearing is high as the base layer and barrier layer can induce an undesired tearing.

Tests made by Applicant have shown that when a film with a tearing directionality is provided with two grooves parallel to the preferred tearing direction, a constant width of the opening formed after tearing the central strip could not be ensured.

It has now been observed that when making cuts or grooves perpendicular to the preferred tearing direction of the film and when tearing the strip in a direction perpendicular to the preferred tearing direction, it was possible to obtain an opening with a substantially constant width.

It has also been observed by Applicant that by selecting the correct material for the sealing member, it was possible to avoid the problem of contamination of the toner with fibrous material.

SUMMARY OF THE INVENTION

The invention relates to a sealing film for toner cartridge, said film having a longitudinal portion to be torn out, said longitudinal portion extending between a first line and a second line and to be torn between a first end and a second end, wherein said sealing film comprises a layer with a thickness comprised between 20 $\mu$m and 1 mm and with a preferred substantially linear tearing direction. Said layer is provided at least with a first longitudinal surface recess, such as a groove, preferably a cut, extending along the first line and a second longitudinal surface recess such as a groove, preferably a cut, extending along the second line, whereby said longitudinal surface elements extend in a direction of at least 5° with respect to the preferred substantially linear tearing directions.

The total thickness of the sealing film or at least of the portion thereof to be torn out is preferably lower to 400 $\mu$m, such as lower than 300 $\mu$m, lower than 200 $\mu$m. Examples of thickness are 30 $\mu$m, 50 $\mu$m, 75 $\mu$m, 100 $\mu$m, 120 $\mu$m, 150 $\mu$m, 175 $\mu$m.

The film can have a laminated structure, but has preferably a structure comprising at most two laminated layer. When the film is a laminated structure of two layers having parallel tearing directions, it is advantageous to provide the film on both faces with surface elements selected from the group consisting of cuts, grooves, recesses and combinations thereof.

A preferred substantially linear tearing direction is the direction along which a linear tear line extends due to a tearing force.

The layer provided with the longitudinal surface elements (cuts, grooves, recesses, combinations thereof) is preferably a layer which requires means for lowering the initial tearing force, such as cuts, perforations, etc.

Advantageously, said longitudinal surface cuts, grooves, recesses or combinations thereof form an angle comprised between 5° and 175° with respect to the preferred substantially linear tearing direction and extend partially into the thickness of the layer so as not to transverse the layer.

Advantageously, the longitudinal surface cuts, grooves, recesses or combinations thereof form an angle between 45° and 135° with respect to the preferred substantially linear direction.

Preferably, the longitudinal surface cuts, grooves, recesses or combinations thereof form an angle of about 90° with respect to the preferred substantially linear direction.

Advantageously, the longitudinal surface cuts, grooves, recesses or combinations thereof extend at least at a distance of more than 1 cm from the first end of the portion.

Preferably, the longitudinal surface cuts, grooves, recesses or combinations thereof are associated with a means for lowering the initial tearing force.

For example, the cuts, grooves, recesses or combinations thereof are located on a face of the film intended to be directed towards the toner cartridge.

According to a specific embodiment, the first and second longitudinal surface cuts, recesses or grooves are substantially perpendicular to the preferred linear tearing direction, while said first and second longitudinal surface cuts, grooves or recesses extend substantially from the first end up to the second end.

According to a possible embodiment, the film comprises a first series of longitudinal surface cuts, grooves or recesses extending along the first line and a second longitudinal surface cuts, grooves or recesses extending along the second line.

For example, the cuts, grooves or recesses of a series are spaced from each other with a distance of less than 10 mm, advantageously of less than 2 mm, preferably of less than 1 mm.

According to a detail of a embodiment, the cuts, grooves or recesses have a maximum depth corresponding to 75% of the thickness of the layer.

According to another detail of an embodiment, at least one portion of cuts, grooves or recesses has a minimal depth corresponding to at least 10% of the thickness of the layer, preferably corresponding to at least 20% of the thickness of the layer, most preferably corresponding to at least 30% of the thickness of the layer.

The cuts, grooves or recesses may have a constant or variable depth.

The film is preferably a monolayer film provided with adhesive means. The film can be a bi-directional film. The adhesive can be a contact glue, a pressure glue, a hot-melt glue, etc. The adhesive, preferably the hot-melt adhesive can be associated to heating means (which can be removed or not from the adhesive after a heating step), such as conductive means, conductive layer, electric conducting wire or layer, etc. Such adhesive (with or without heating means or removable heating means) can also be used in sealing member comprising a multilayered film.

The monolayer film has advantageously a thickness of less than 400 μm, preferably of less than 300 μm, such as 25 μm, 40 μm, 50 μm, 70 μm, 90 μm, 110 μm, 125 μm.

The sealing film is advantageously provided with adhesive means and with a removable protecting layer to be removed for attaching the film on the toner cartridge.

The sealing film is preferably provided with a pulling means connected to the portion to be torn. The pulling means is for example a portion of the film, or can be a band attached to the strip to be torn.

The layer is for example a layer selected from the group consisting of uniaxially oriented polyethylene film, uniaxially oriented polypropylene film, bi phase polymer film, films made of incompatible compounds, biaxially oriented polypropylene, biaxially oriented polyethylene, and mixtures thereof. The layer can be reinforced (for example with a mat of fibres, a non woven material or fabric), non reinforced, laminated or not laminated, glued or not glued to a flexible support, etc.

The invention relates also to a toner container or a toner cartridge comprising a sealing film of the invention, as disclosed here before.

The invention further relates to a method for opening a sealing member of a toner cartridge or container, in which the central strip is torn out in a direction different from the preferred tearing direction of the film.

It has also been observed that the tearing is facilitated or more precise, when reinforcing the lateral edges of the pulling means of the sealing strip, when the pulling means is integral with the sealing member. The invention relates thus also to a sealing member provided with an integral pulling means, the lateral edges of which are reinforced.

DESCRIPTION OF PREFERRED EMBODIMENTS

Figure 1:
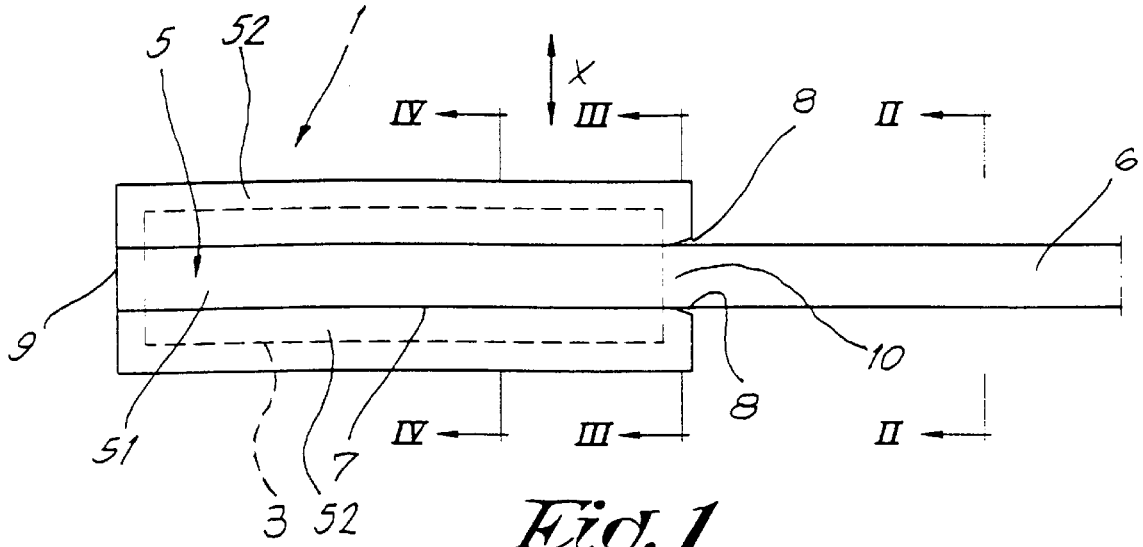
FIG. 1 is an upper view of a sealing member of the invention.

The sealing member 1 of FIG. 1 is intended to be used for sealing a toner cartridge, such as a recycled toner container of a toner cartridge. Toner cartridge provided with sealing member are disclosed for example in U.S. Pat. No. 5,826,140, the content of which is incorporated by reference.

The sealing member 1 comprises:

- a sealing film 2 made for example in a mono oriented polymer (such as uniaxially oriented polymer, preferably non foamed mono oriented polymer, most preferably non foamed stretched mono oriented polypropylene), said film being a mono layer with a thickness E comprised between 50 and 200 μm, such as 75, 100 or 110 μm,
- an adhesive layer 3, and
- a removable protection layer or film 4 (such as a silicone paper) to be removed so as to render the adhesive layer free for contacting a surface of the toner container.

The sealing film 2 comprises:

- a sealing portion 5 with a central portion 51 intended to be torn out and two lateral portions 52, and
- a pulling portion 6 forming an extension of the central portion 51.

The sealing film is oriented and has a preferred tearing direction X. It means that in case a cut is formed in the film in the direction X, the film can be cut with an easy manual tearing. In another direction than direction X, the force required for developing a linear cut from an initial cut is not possible, except along the grooves or recesses 7 formed in the films. As it can be seen the central portion or strip 51 is intended to be torn in a direction which is perpendicular to the preferred tearing direction of the film (X). The film have substantial tensile strength in the axial direction X and relatively less strength in a directional perpendicular to said direction X. The film is for example a fibrous non woven material having aligned fibers (parallel to the direction X) lightly fused together in a synthetic resinous layer. The film is preferably a non stretched film.

The grooves, cuts or recesses 7 have a depth D corresponding to about 30 to 50% of the thickness E of the film.

Said grooves, cuts or recesses are preferably formed by a heating process, for example by using a heated cutting means or by pressing a heating means provided with one or more longitudinal heated lines or protuberances. Said grooves, cuts or recesses are preferably made at a temperature higher than the soft temperature of the film, most preferably at a temperature higher than a glass transition temperature of the material of the film, most preferably at a temperature higher than the melting temperature of at least one polymer material present in the film or at a temperature higher than the melting temperature of the film. For example, when the film is made of a blend of two incompatible or substantially incompatible polymers, the heating step is carried out at a temperature sufficient for melting one polymer, while not melting the other. When the film consists of a series of linear wires or fibres made in a first composition or polymer, said series of wires or fibres being connected or laminated with a polymer layer, said laminated polymer layer has advantageously a softening temperature higher than the softening temperature of the first polymer, preferably a melting temperature higher than the melting temperature of the melting temperature of the first polymer or polymer composition. The grooves or recesses or cuts are for example formed by means of a linear welding head, so as to exert a pressure on the film during the fusing of at least a portion of the film, preferably the fusing of at least a portion of the longitudinal polymer fibres of the film at the place of the groove or recesses or cuts 7. The welding operation, when used is advantageously an ultrasonic welding. A laser can possibly be used for making the groove, however the risk to perforated the film is too high, when the thickness is lower than 300 $\mu$m. Now, it is preferred to have thickness of less than 300 $\mu$m, in order to have sufficient flexibility, so as to bent correctly the pulling means and the strip during its tearing.

The sealing portion 5 is provided with two cuts 8 at the end of the central portion 51 adjacent to the pulling means or strip 6, said cuts forming a means for lowering the initial tearing force required for tearing the central portion 51. Depending of the used material, means for lowering the initial tearing force or for initiating the tearing are or not required for enabling a manual tearing of the strip 51. Preferably, in order to avoid accidental tearing, the film is made in a material requiring means for lowering the initial tearing force or for initiating the tearing (8).

In FIG. 1, the film is provides with longitudinal cuts 7 extending partially in the thickness of the film (so as to avoid the perforation of the film), said longitudinal surface cuts 7 extending from the means for lowering the initial tearing force (8) up to the end 9 of the strip 51 opposed to the end 10 of the strip 51 adjacent to the pulling means 6.

Figure 2:
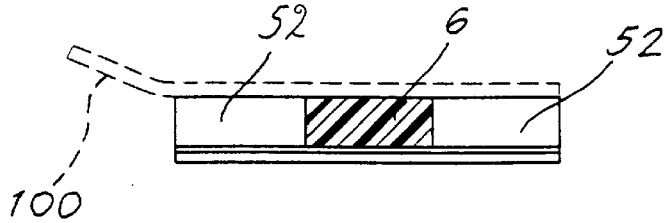
FIGS. 2 to 4 are cross section views along the line II—II, III—III and IV—IV respectively.
Figure 3:
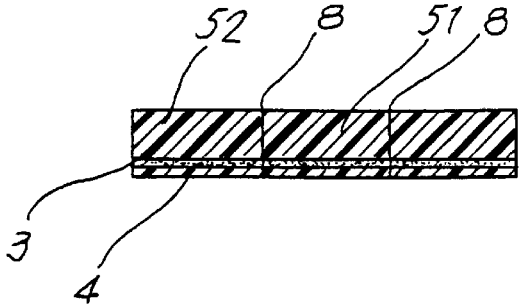
Figure 4:
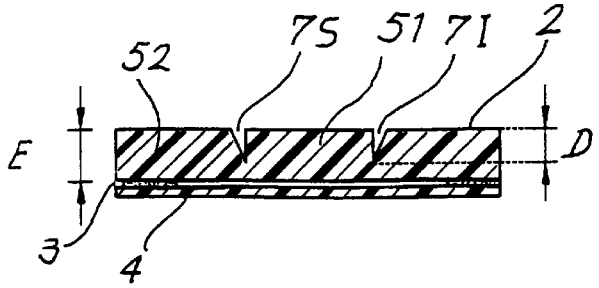
Figure 20:
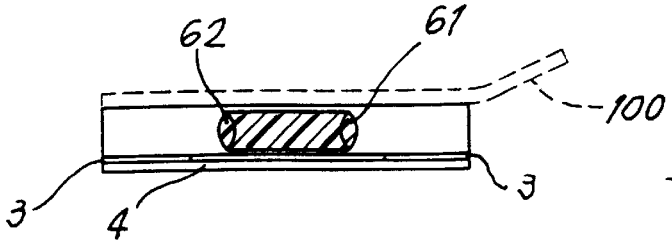
FIG. 20 is a cross section view along the line XX—XX.

The sealing member is advantageously associated with one or more substantially rigid supports (100 shown schematically in dashed line in FIG. 2 and in FIG. 20) or elements suitable for increasing the rigidity of at least a portion of the sealing member. Said support(s) or element(s) can be removed after placement of the sealing member on the toner container. Such a substantially rigid support is disclosed in Re 36,920, the scope of which is incorporated herewith by reference.

Figure 5:
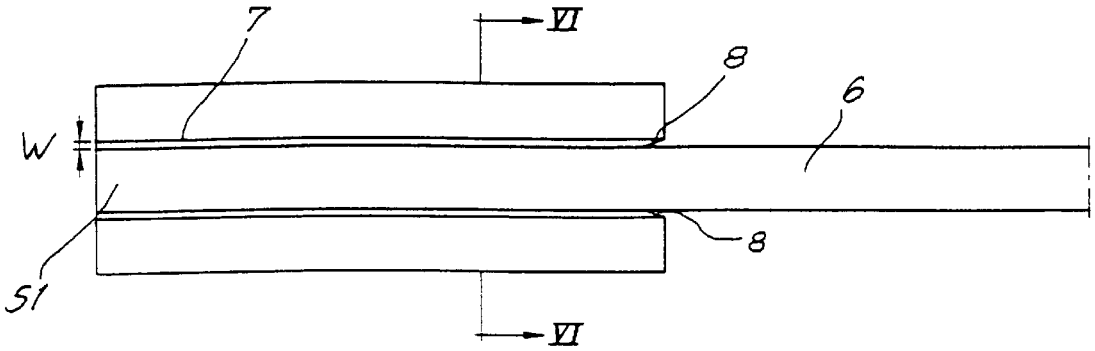
FIG. 5 is an upper view of another embodiment of the invention.
Figure 6:
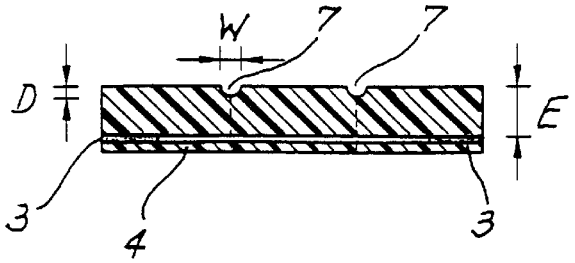
FIG. 6 is a cross section view along the line VI—VI

In the embodiment of FIG. 5, the sealing member is similar to that of FIG. 1, except that the sealing film is provided with two parallel grooves 8 perpendicular to the preferred tearing direction of the film (X). The grooves have a depth D corresponding to about 30–60% of the thickness (E) of the film, while the width (W) of the grooves (at the upper face) is for example at least equal to the depth of the groove, preferably at least equal to twice said depth, such as 2, 3, 4, 5 times the depth, or even more.

Figure 7:
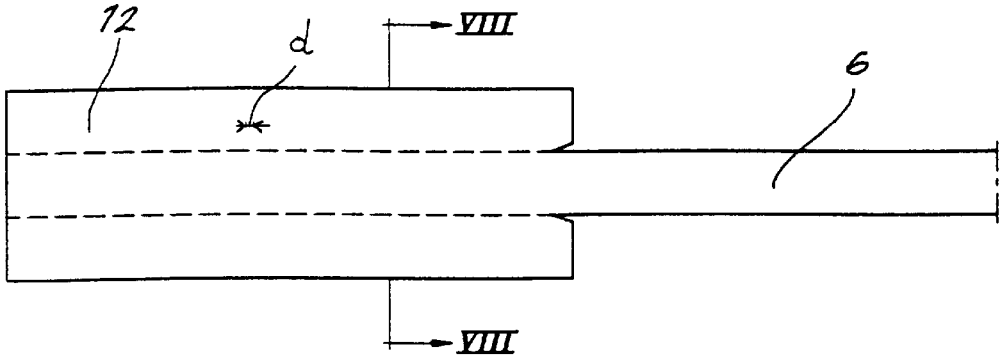
FIG. 7 is an upper view of still another embodiment
Figure 8:
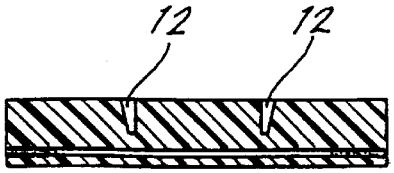
FIG. 8 is a cross section view along the line VIII—VIII

The embodiment of FIG. 7 is similar to that of FIG. 1, except that the surface cut lines are each replaced by a series of adjacent surface cuts 12 spaced from each other with a distance d of less than 2 mm, such as less than 1 mm, such as 500 $\mu$m, 250 $\mu$m, 125 $\mu$m (for example with a distance lower to or equal to the thickness of the film).

Figure 9:
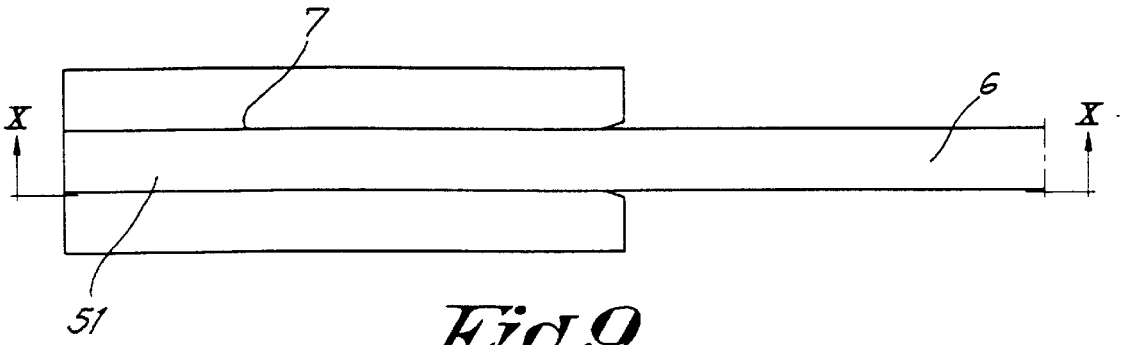
FIG. 9 is an upper view of a sealing member similar to that of FIG. 1
Figure 10:
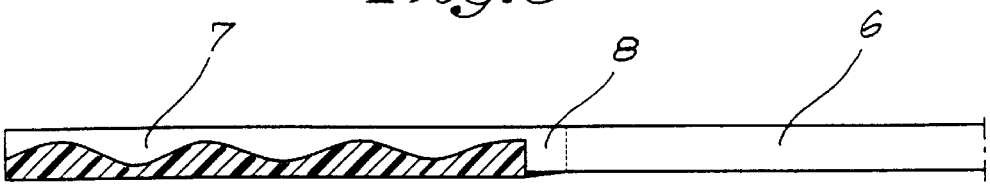
FIG. 10 is a cross section view along the line X—X

The embodiment of FIG. 9 is similar to that of FIG. 1, except that the surface cut lines 7 have a variable depth, for example a depth, for example a depth varying between 20 and 65% of the thickness of the film.

Figure 11:
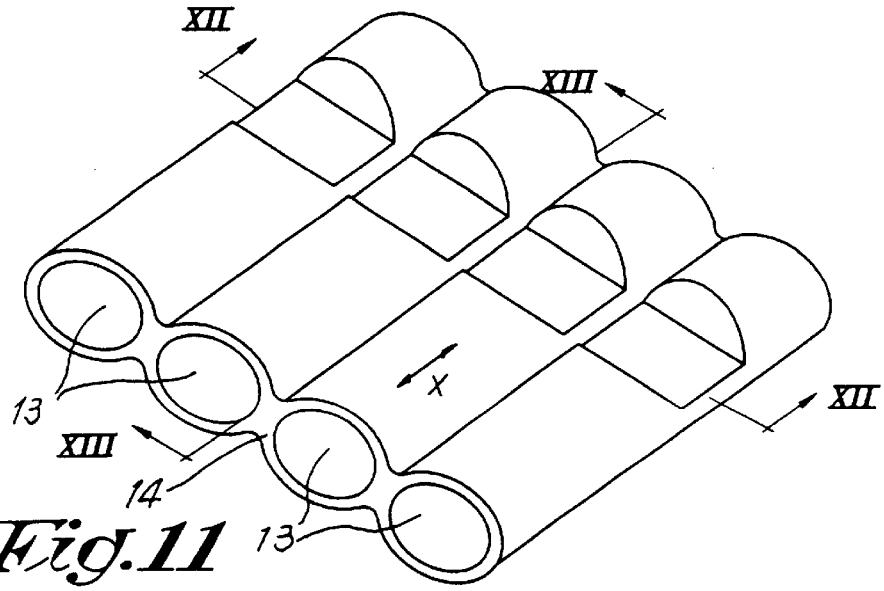
FIG. 11 is an enlarged perspective view of a section of the sealing member provided with a groove perpendicular to the preferred tearing direction
Figure 12:
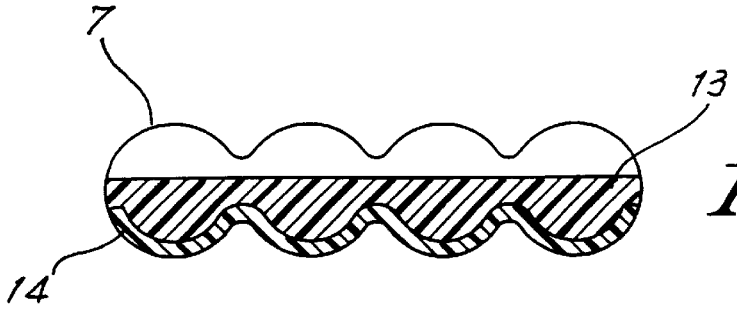
FIGS. 12 and 13 are cross section views along the lines XII—XII and XIII—XIII
Figure 13:
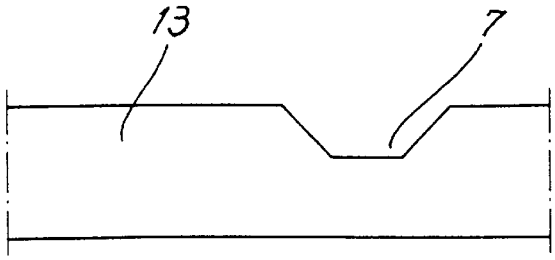

FIG. 11 is an enlarged view of a portion of a sealing film suitable for the sealing member of the invention. Said sealing film has a structure corresponding to a series of substantially parallel fibres 13 bound to each other for example by means of an embedding layer or a covering layer 14. The groove 7 is made within the thickness of the film. In this preferred embodiment, substantially no protuberance is formed above the film along the edge of the groove.

Figure 14:
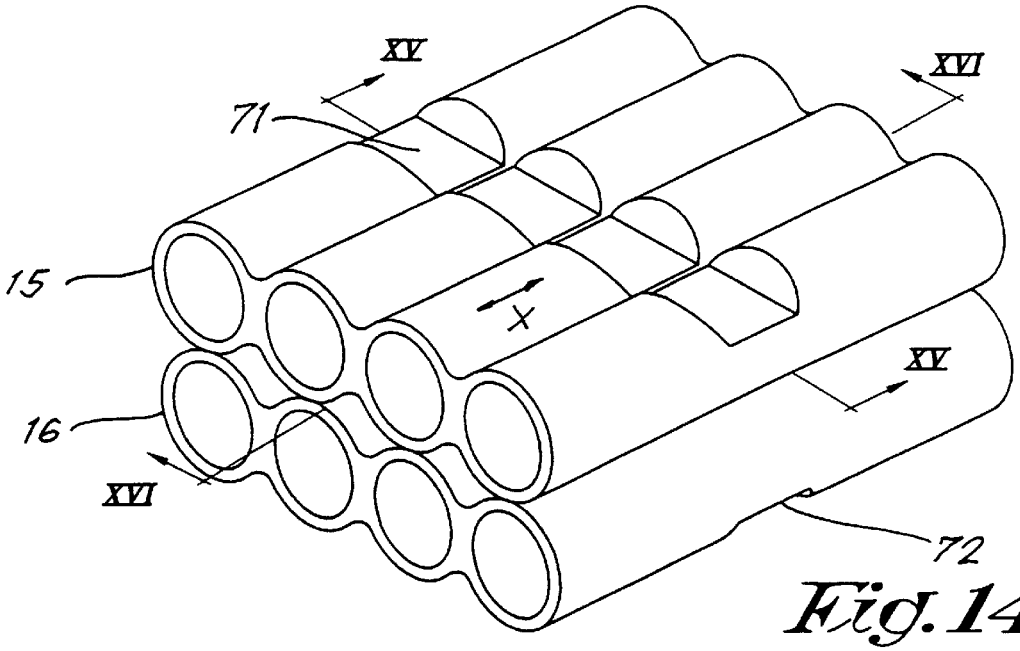
FIG. 14 is an enlarged view similar to that of FIG. 11
Figure 15:
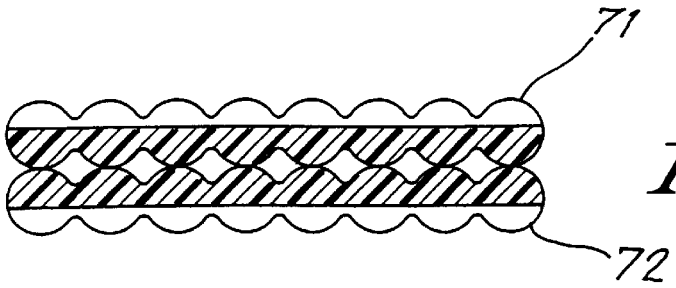
FIGS. 15 and 16 are cross section view along the lines XV—XV and XVI—XVI
Figure 16:
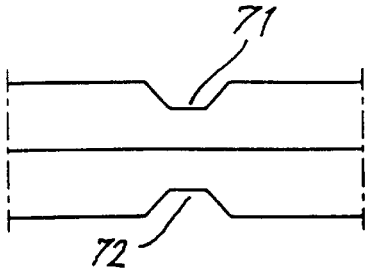

FIG. 14 is a view similar to the FIG. 11, except that the film consists of a laminated product comprising an upper mono oriented layer 15 and a lower mono oriented layer 16 (the fibres of said two layers being substantially parallel to each other). In this embodiment, a groove, cut, recess 71 is formed in the upper layer 15 and a groove, cut or recess 72 is formed in the lower layer 16.

Figure 17:
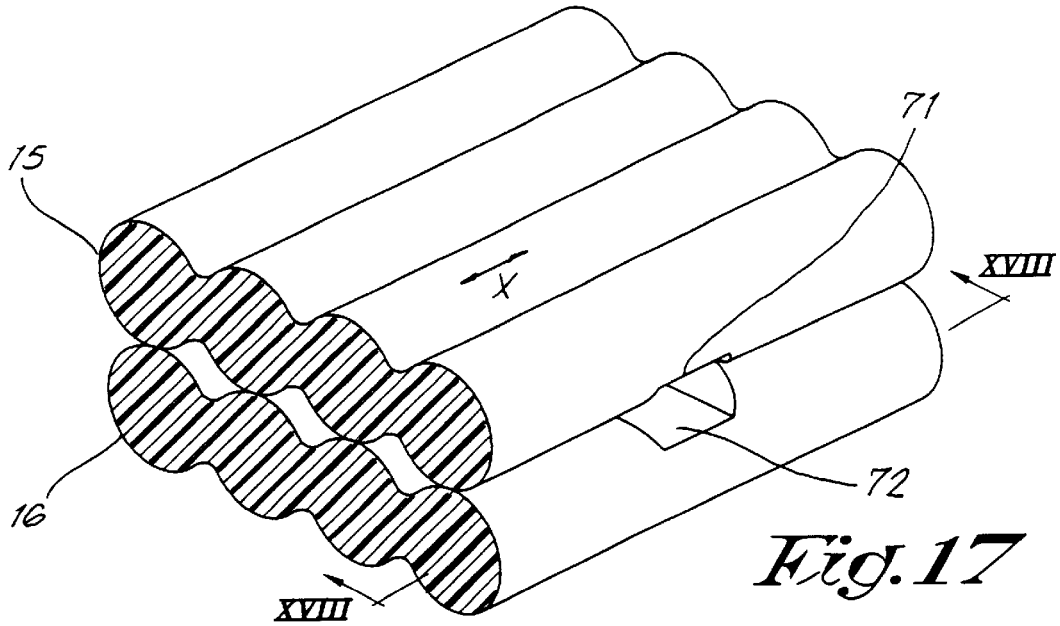
FIG. 17 is a view similar to that of FIG. 14
Figure 18:
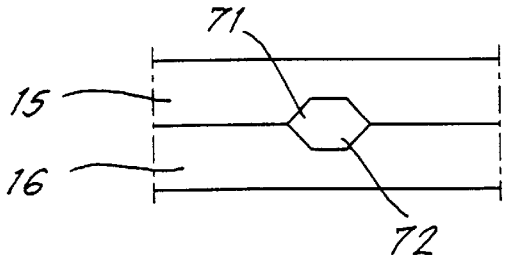
FIG. 18 is a cross section view along the line XVIII—XVIII

The embodiment of FIG. 17 is similar to that of FIG. 14, except that the groove, cut, recess is formed separately in the upper layer 15 and in the lower layer 16 before laminating the layers together so that the grooves, cuts or recesses 71, 72 are directed towards each other and form together an inner chamber or inner channel.

Figure 19:
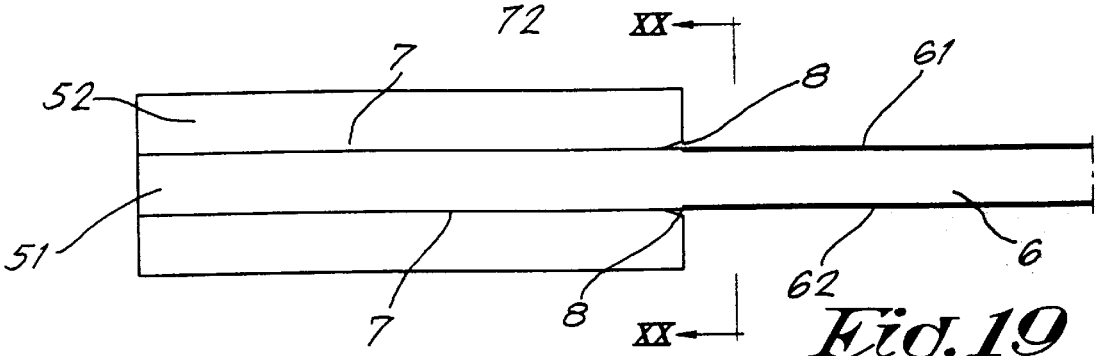
FIG. 19 is an upper view of a sealing member similar to that of FIG. 1

FIG. 19 is a view of an embodiment similar to that of FIG. 1, except that the lateral edges 61,62 of the pulling means 6 are reinforced, for example by means of a heating step, such as a welding step or a burning step. This enables to give more rigidity to the pulling means, whereby avoiding any risk that the pulling means does not remain in correct place in the toner cartridge due to movement, such as its transport.

For simplifying the placement of a seal of the invention, the sealing member as disclosed in the drawings can be provided with a support means, such as a cardboard support means.

What I claim is:

1. Sealing film for toner cartridge, said film having a longitudinal portion to be torn out, said longitudinal portion extending between a first line and a second line and to be adapted to be torn between a first end and a second end, wherein said sealing film comprises a layer with a thickness comprised between 20 $\mu$m and 1 mm and with one preferred substantially linear tearing direction, said layer being provided with:

at least with a first longitudinal surface element selected from the group consisting of cuts, grooves, recesses and combinations thereof and extending along the first line, and a second longitudinal surface element selected from the group consisting of cuts, grooves, recesses and combinations thereof and extending along the second line, whereby said longitudinal surface elements extend in a direction of at least 5° with respect to the preferred substantially linear tearing direction.

2. The sealing of claim 1, in which said longitudinal surface elements form an angle comprised between 5° and 175° with respect to the preferred substantially linear tearing direction and in which said longitudinal surface elements extend only partially into the thickness of the layer so as not to transverse the layer.

3. The sealing film of claim 1, in which the longitudinal surface elements form an angle between 45° and 135° with respect to the preferred substantially linear direction.

4. The sealing film of claim 1, in which the longitudinal surface elements form an angle of about 90° with respect to the preferred substantially linear direction.

5. The sealing film of claim 1, in which the longitudinal surface elements extend at least at a distance of more than 1 cm from the first end of the portion.

6. The sealing film of claim 1, in which the longitudinal surface elements are associated with a means for lowering the initial tearing force.

7. The sealing film of claim 1, in which the longitudinal surface elements are located on a face of the film intended to be directed towards the toner cartridge.

8. The sealing film of claim 1, in which the first and second longitudinal surface elements are substantially perpendicular to the preferred linear tearing direction, and in which said first and second longitudinal surface elements extend substantially from the first end up to the second end.

9. The sealing film of claim 1, which comprises a first series of longitudinal surface elements extending along the first line and a second series of longitudinal surface elements extending along the second line.

10. The sealing film of claim 9, in which the elements of a series are spaced from each other with a distance of less than 10 mm.

11. The sealing film of claim 1, in which the elements have a maximum depth corresponding to 75% of the thickness of the layer.

12. The sealing film of claim 1, in which at least one portion of elements has a minimal depth corresponding to at least 10% of the thickness of the layer.

13. The sealing film of claim 1, in which at least one portion of elements has a minimal depth corresponding to at least 20% of the thickness of the layer.

14. The sealing film of claim 1, in which at least one portion of elements has a minimal depth corresponding to at least 30% of the thickness of the layer.

15. The sealing film of claim 1, in which the elements have a variable depth.

16. The sealing film of claim 1, in which the film is a monolayer film provided with adhesive means.

17. The sealing film of claim 1, in which the film is a non stretched film.

18. The sealing film of claim 1, which is provided with adhesive means and with a removable protecting layer to be removed for attaching the film on the toner cartridge.

19. The sealing film of claim 1, which is provided with a pulling means connected to the portion to be torn.

20. The sealing film of claim 1, in which the layer is a layer selected from the group consisting of uniaxially oriented polyethylene film, uniaxially oriented polypropylene film, bi phase polymer film, films made of incompatible compounds, biaxially oriented polypropylene, biaxially oriented polyethylene, and mixtures thereof.

21. The sealing film of claim 1, in which the surface elements are cuts extending partially in the thickness of the layer.

22. The sealing member of claim 1, which is provided with a removable rigidifying means for facilitating the placement of the sealing member on a surface of a toner container.

23. A sealing means for a toner cartridge, said sealing means comprising a film structure, a first portion of which is adapted for sealing an opening of the toner cartridge, said first portion having a central portion intended to be torn, while a second portion is adapted for making a pulling means connected to the central portion to be torn, the first portion comprising a sealing film as in claim 1.

24. The sealing means of claim 23, which is provided with a removable rigidifying means for facilitating the placement of the sealing means on a surface of a toner container.

25. A sealing member for sealing an opening of a toner holder or a toner cartridge, said sealing member-comprising a film with a central portion adapted to be torn out and being adapted to be connected to a pulling means, said film is a monolayer sealing film as in claim 1 with a thickness comprised between 20 $\mu$m and 400 $\mu$m.

26. The sealing member of claim 25, in which the monolayer film is a non fibrous layer.

27. The sealing member of claim 25, in which the monolayer film comprises polypropylene.

28. The sealing member of claim 25, in which the monolayer film is a mono oriented polypropylene film.

29. The sealing member of claim 25, in which the monolayer film is provided with means for lowering the initial tearing force.

30. The sealing member of claim 29, in which the means for lowering the initial tearing force are cuts in the film, said cuts being adjacent to the pulling means.

31. The sealing member of claim 25, which is provided with a removable rigidifying means for facilitating the placement of the sealing member on a surface of a toner container.

32. A sealing film for toner cartridge, said film having a longitudinal portion to be torn out, said longitudinal portion extending between a first line and a second line and to be adapted to be torn between a first end and a second end, wherein said sealing film comprises a layer with a thickness comprised between 20 $\mu$m and 1 mm and with two preferred substantially linear tearing directions, said layer being provided with:

at least with a first longitudinal surface element selected from the group consisting of cuts, grooves, recesses and combinations thereof and extending along the first line, and a second longitudinal surface element selected from the group consisting of cuts, grooves, recesses and combinations thereof and extending along the second line, whereby said longitudinal surface elements extend in a direction of at least 5° with respect to the preferred substantially linear tearing directions.

33. A sealing means for a toner cartridge, said sealing means comprising a film structure, a first portion of which is adapted for sealing an opening of the toner cartridge, said first portion having a central portion intended to be torn, while a second portion of which is adapted for making a pulling means connected to the central portion to be torn, whereby the first portion comprises a sealing film of claim 32.

34. A sealing member for sealing an opening of a toner holder or a toner cartridge, said sealing member comprising a film with a central portion adapted to be torn out and being adapted to be connected to a pulling means, whereby said film is a monolayer sealing film as in claim 32 with a thickness comprised between 20 $\mu$m and 400 $\mu$m.

35. A sealing means for a toner cartridge, said sealing means comprising a film structure, a first portion of which is adapted for sealing an opening of the toner cartridge, said first portion having a central portion intended to be torn, while a second portion of which is adapted for making a pulling means connected to the central portion to be torn, whereby the first portion comprises a sealing film as in claim 32.

36. The sealing member of claim 35, which is provided with a removable rigidifying means for facilitating the placement of the sealing member on a surface of a toner container.

37. A sealing member for sealing an opening of a toner holder or a toner cartridge, said sealing member comprising a film with a central portion adapted to be torn out and being adapted to be connected to a pulling means, whereby said film is a monolayer sealing film of claim 32 with a thickness comprised between 20 $\mu$m and 400 $\mu$m.

38. A toner holder selected from the group consisting of toner containers and toner cartridges, said holder being provided with a sealing film for closing an opening of the toner holder, said sealing film having a longitudinal portion to be torn out, said longitudinal portion extending between a first line and a second line and to be torn between a first end and a second end, wherein said sealing film comprises a layer with a thickness comprised between 20 μm and 1 mm and with a preferred substantially linear tearing direction, said layer being provided with:

at least with a first longitudinal surface element selected from the group consisting of cuts, grooves, recesses and combinations thereof and extending along the first line, and a second longitudinal surface element selected from the group consisting of cuts, grooves, recesses and combinations thereof and extending along the second line, whereby longitudinal surface elements extend in a direction of at least 5° with respect to the preferred substantially linear tearing direction.

39. The toner holder of claim 38, in which the longitudinal surface elements form an angle comprised between 5° and 175° with respect to the preferred substantially linear tearing direction and extend partially into the thickness of the layer so as not to transverse the layer.

40. The toner holder of claim 38, in which the longitudinal surface elements form an angle between 45° and 135° with respect to the preferred substantially linear tearing direction.

41. The toner holder of claim 38, in which the longitudinal surface elements form an angle of about 90° with respect to the preferred substantially linear tearing direction.

42. The toner holder of claim 38, in which the longitudinal surface elements extend at least at a distance of more than 1 cm from the first end of the portion.

43. The toner holder of claim 38, in which the longitudinal surface elements are associated with a means for lowering the initial tearing force.

44. The toner holder of claim 38, in which the longitudinal surface elements are located on a face of the film intended to be directed towards the toner holder.

45. The toner holder of claim 38, in which the first and second longitudinal surface elements are substantially perpendicular to the preferred longitudinal tearing direction, and in which said first and second longitudinal surface elements extend substantially from the first end up to the second end.

46. The toner holder of claim 38, which comprises a first series of longitudinal surface elements extending along the first line and a second series of longitudinal surface elements extending along the second line.

47. The toner holder of the claim 46, in which the elements of a series are spaced from each with a distance of less than 10 mm.

48. The toner holder of claim 38, in which the elements have a maximum depth corresponding to 75% of the thickness of the layer.

49. The toner holder of claim 38, in which at least one portion of elements has a minimal depth corresponding to at least 10% of the thickness of the layer.

50. The toner holder of claim 38, in which at least one portion of elements has a minimal depth corresponding to at least 20% of the thickness of the layer.

51. The toner holder of claim 38, in which at least one portion of elements has a minimal depth corresponding to at least 30% of the thickness of the layer.

52. The toner holder of claim 38, in which the elements have a variable depth.

53. The toner holder of claim 38, in which the film is a monolayer film provided with adhesive means.

54. The toner holder of claims 38, in which the sealing film is glued on the toner container.

55. The toner holder of claim 38, in which the sealing film is provided with a pulling means connected to the portion to be torn.

56. The toner holder of claim 38, in which the layer is a layer selected from the group consisting of mono oriented polyethylene film, mono oriented polypropylene film, bi phase polymer film, and films made of incompatible compound.

57. The toner holder of claim 38, in which the elements are cuts extending partially in the thickness of the layer.

58. A toner holder selected from the group consisting of toner containers and toner cartridges said holder being provided with a sealing film for closing an opening of the toner holder, said sealing film having a longitudinal portion to be torn out, said longitudinal portion extending between a first line and a second line and to be torn between a first end and a second end, wherein said sealing film comprises a layer with a thickness comprised between 20 μm and 1 mm and with two preferred substantially linear tearing directions, said layer being provided with:

at least with a first longitudinal surface element selected from the group consisting of cuts, grooves, recesses and combinations thereof and extending along the first line, and a second longitudinal surface element selected from the group consisting of cuts, grooves, recesses and combinations thereof and extending along the second line, whereby said longitudinal surface elements extend in a direction of at least 5° with respect to the preferred substantially linear tearing directions.

59. A method for opening a sealing film closing a longitudinal opening of a toner cartridge or container, said film having a longitudinal portion to be torn out, said longitudinal portion extending between a first line and a second line and to be adapted to be torn between a first end and a second end, wherein said sealing film comprises a layer with a thickness comprised between 20 μm and 1 mm and with one preferred substantially linear tearing direction, said layer being provided with:

at least with a first longitudinal surface element selected from the group consisting of cuts, grooves, recesses and combinations thereof and extending along the first line, and a second longitudinal surface element selected from the group consisting of cuts, grooves, recesses and combinations thereof and extending along the second line, whereby said first and second lines extend in a direction of at least 5° with respect to the preferred substantially linear tearing direction.

60. A method for opening a sealing film closing a longitudinal opening of a toner cartridge or container, said film having a longitudinal portion to be torn out, said longitudinal portion extending between a first line and a second line and to be adapted to be torn between a first end and a second end, wherein said sealing film comprises a layer with a thickness comprised between 20 μm and 1 mm and with two preferred substantially linear tearing directions, said layer being provided with:

at least with a first longitudinal surface element selected from the group consisting of cuts, grooves, recesses and combinations thereof and extending along the first line, and a second longitudinal surface element selected from the group consisting of cuts, grooves, recesses and combinations thereof and extending along the second line, whereby said first and second lines extend in a direction of at least 5° with respect to the preferred substantially linear tearing directions.

* * * * *